US005487409A

United States Patent [19]

Stoll et al.

[11] Patent Number: 5,487,409

[45] Date of Patent: Jan. 30, 1996

[54] SPOOL VALVE

[75] Inventors: Kurt Stoll, Esslingen, Germany; Jan R. de Fries, Wallisellen, Switzerland; Herbert Köngeter, Reichenbach, Germany

[73] Assignee: Festo KG, Esslingen, Germany

[21] Appl. No.: 269,759

[22] Filed: Jul. 1, 1994

[30] Foreign Application Priority Data

Jul. 24, 1993 [DE] Germany ..... 43 24 939.6

[51] Int. Cl.[6] ..... F15B 13/042

[52] U.S. Cl. ..... 137/625.64; 137/625.66; 137/625.69; 251/367

[58] Field of Search ..... 137/625.64, 625.66, 137/625.69; 251/367

[56] References Cited

U.S. PATENT DOCUMENTS

| | | | |
|---|---|---|---|
| 2,295,111 | 9/1942 | Hemmings | 251/367 X |
| 3,092,141 | 6/1963 | Stark | 251/367 |
| 3,270,776 | 9/1966 | Carls | 137/625.64 |
| 4,617,968 | 10/1986 | Hendrixon | 137/625.64 |
| 5,222,715 | 6/1993 | Framberg . | |
| 5,361,803 | 11/1994 | Stoll | 137/625.69 X |

FOREIGN PATENT DOCUMENTS

| | | | |
|---|---|---|---|
| 0033303 | 8/1981 | European Pat. Off. | 137/625.69 |
| 1917598 | 12/1977 | Germany | 137/625.66 |

*Primary Examiner*—Gerald A. Michalsky
*Attorney, Agent, or Firm*—Hoffmann & Baron

[57] ABSTRACT

A spool valve possesses a longitudinally divided valve housing, in the case of which housing parts are assembled with longitudinal sides fitted together. In the wall of the valve housing valve ducts are provided. In order to enable simplification of the manufacture of such valve housings at least part of the length of a valve duct extends in the parting interface of the valve housing. In this respect the wall of the valve duct is made up of complementary peripheral wall portion, which are provided at the housing parts adjacent to each other in the parting interface.

18 Claims, 2 Drawing Sheets

Fig. 1
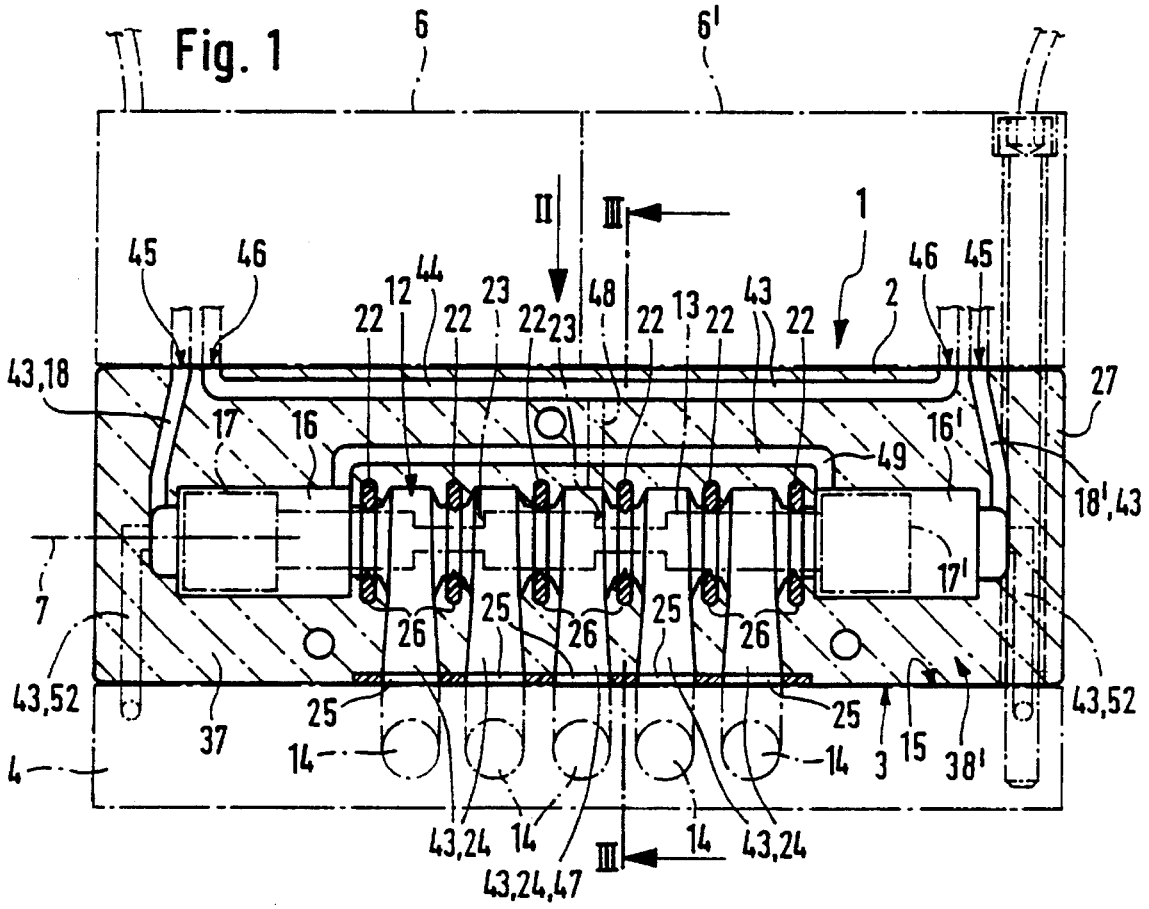
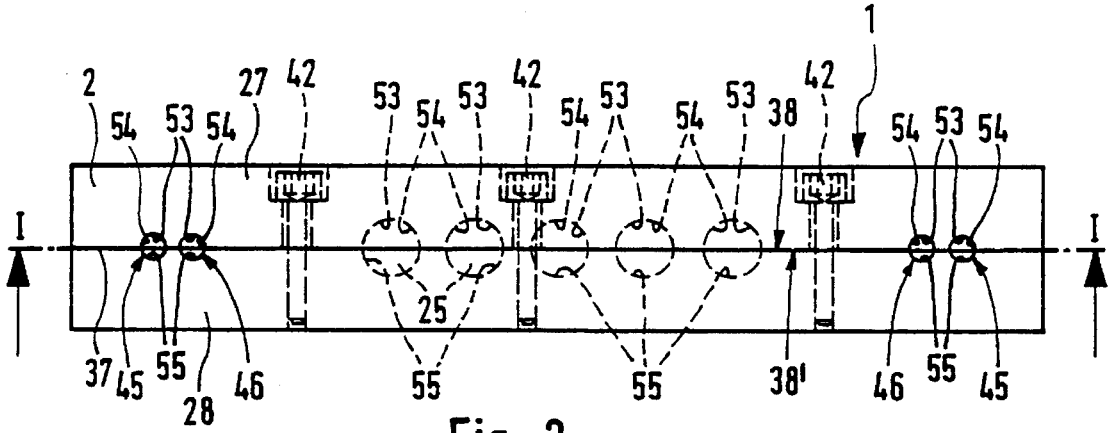
Fig. 2

SPOOL VALVE

BACKGROUND OF THE INVENTION

The invention relates to a spool valve comprising a valve housing in whose interior an axially extending spool receiving means is provided, in which a spool is located, the valve housing being longitudinally divided adjacent to said spool receiving means and having a plurality of housing parts fitted together along longitudinal sides thereof, a sealing arrangement adapted to function to define flow paths in the valve between the spool and a wall integral with the housing, and valve ducts serving to direct a working fluid, said ducts extending in the wall of the valve housing.

Such a valve as disclosed in the European patent publication 0 122 247 B1 comprises a valve housing, in whose interior a sleeve is arranged, which functions as means receiving the spool to allow longitudinal movement thereof. The spool bears a sealing arrangement in the form of individual sealing rings and dynamically cooperating with the internal surface of the sleeve constituting a wall integral with the housing in order to define various different flow paths for a working fluid in accordance with the particular setting of the spool. In the wall of the valve housing valve ducts extend to provide for supply and removal of the working fluid, Further valve ducts are designed in the form of control valve ducts, by means of which the actuating means of the spool valve may be supplied with working fluid in order to cause a switching over of the fluid. For the insertion of the sleeve and of the spool valve the valve housing is longitudinally divided along the spool receiving space into two halves.

A spool valve also with a longitudinally divided valve housing is furthermore disclosed in the prior German patent application P 42 23 358.5. It offers the advantage over the valve in accordance with the said European patent publication 0 122 247 B1 that no sleeve is required since as a sealing arrangement sealing rings are employed, which are seated in holding recesses in the divided valve housing and are able to enter into direct dynamic contact with the valve spool.

As is the case with conventional valves as well, in a spool valve of the initially mentioned type a substantial degree of complexity has so far been involved in order to provide the valve ducts extending in the wall of the valve housing outside the spool receiving space. As a rule such space is drilled or directly formed in the course of production by casting. Complex forms of ducts are in this case hardly possible at reasonable cost. If valve ducts should be required which are not linear in the longitudinal direction, then as a rule the designer is compelled to adopt lost core casting as a method of manufacture.

SHORT SUMMARY OF THE INVENTION

One object of the invention is accordingly to provide a spool valve of the type initially mentioned which renders possible low-price and simple manufacture even if the valve duct shapes are complex.

In order to achieve this or other objects appearing from the present specification, claims and drawings at least one length portion of such valve duct extends in the parting interface of the valve housing, the duct wall of such length portion being composed of complementary wall peripheral sections, which are provided in the parting interface on the housing parts adjoining each other on longitudinal sides thereof.

If owing to lack of space or owing to external features it is necessary to form a valve duct in the valve housing with a relatively intricate longitudinal configuration it is possible for such valve duct to be arranged more particularly along the critical length portion and preferably along its full length at the parting interface of the valve housing. The duct wall of the respective length portion is in this respect composed of at least two peripheral wall portions, which at the parting interface are formed on the housing parts which come together there. If in the parting interface two housing parts are exactly adjacent, it is then possible for longitudinal grooves to be formed in the facing joint surfaces of the two housing parts to set the longitudinal extent of the duct and which in the assembled state of the housing parts are mutually complementary to give a peripheral closed valve duct. Furthermore it would be feasible as well to incorporate a groove-like recess in only one of the housing parts to set the longitudinal extent of the duct, such recess then being only covered by a non-recessed portion of the joint surface of the other housing part. The configuration in accordance with the invention represents a simplification in the manufacture of the valve housing more particularly in the case of a complicated shape of at least one valve duct, since the surfaces defining the valve duct are accessible prior to the fitting together of the housing parts without any problems. The respective recesses in at least one of the joint surfaces may be machined or formed directly in part of a casting operation, more particularly injection casting. It will be clear that not all valve ducts of the valve housing have to be arranged in this manner, but however as a rule the designer will tend to arrange as many valve ducts as possible in the parting interface.

Further advantageous developments of the invention are recited in the claims.

For the operation of the spool valve a drive space is provided in the valve housing preferably at least one and more especially at both axial end parts of the spool receiving space. This drive space may be a component of the spool receiving space. In at least one of the drive spaces an operating member cooperating with the valve spool is provided, such operating member being for example a diaphragm or a piston, which is able to be moved by fluid pressure in the form of a drive medium. It is convenient if the control drive valve duct opening into the drive space and serving for the supply of the drive medium has at least its length portion adjoining the drive space, and preferably its entire length in the valve housing, in the parting interface.

It is furthermore an advantage if the spool receiving space is not formed in the interior of a sleeve but is rather directly delimited by the housing parts placed together along the longitudinal sides, and which peripherally constitute complementary wall portion of the spool receiving space. As a sealing arrangement in this case it is preferred to provide a plurality of separate seal rings, which are secured in holding recesses in the housing and perform a static sealing function with respect to the valve housing. These sealing rings furthermore encircle the valve spool coaxially and, in order to define the flow ducts cooperate in a dynamic sealing fashion with the external surface of the valve spool, which itself in this case may be designed entirely without any seals.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

FIG. 1 is a longitudinal section taken through a first embodiment of the spool valve, whose valve housing consists of two housing parts, on the section line I—I in FIGS. 2 and 3, the plane of the section extending in the parting interface, which in the working embodiment is flat, between the two housing parts so that the direction of viewing is toward the joint interface of the one housing part, which solely to make the drawing more straightforward is shaded in chained lines, two control valves and a fluid distributing device being indicated in chained lines as optional features of the design.

FIG. 2 is a plane view of the spool valve in accordance with FIG. 1 looking in the direction of the arrow II of FIG. 1.

DETAILED ACCOUNT OF WORKING EMBODIMENTS OF THE INVENTION

Figure 3:
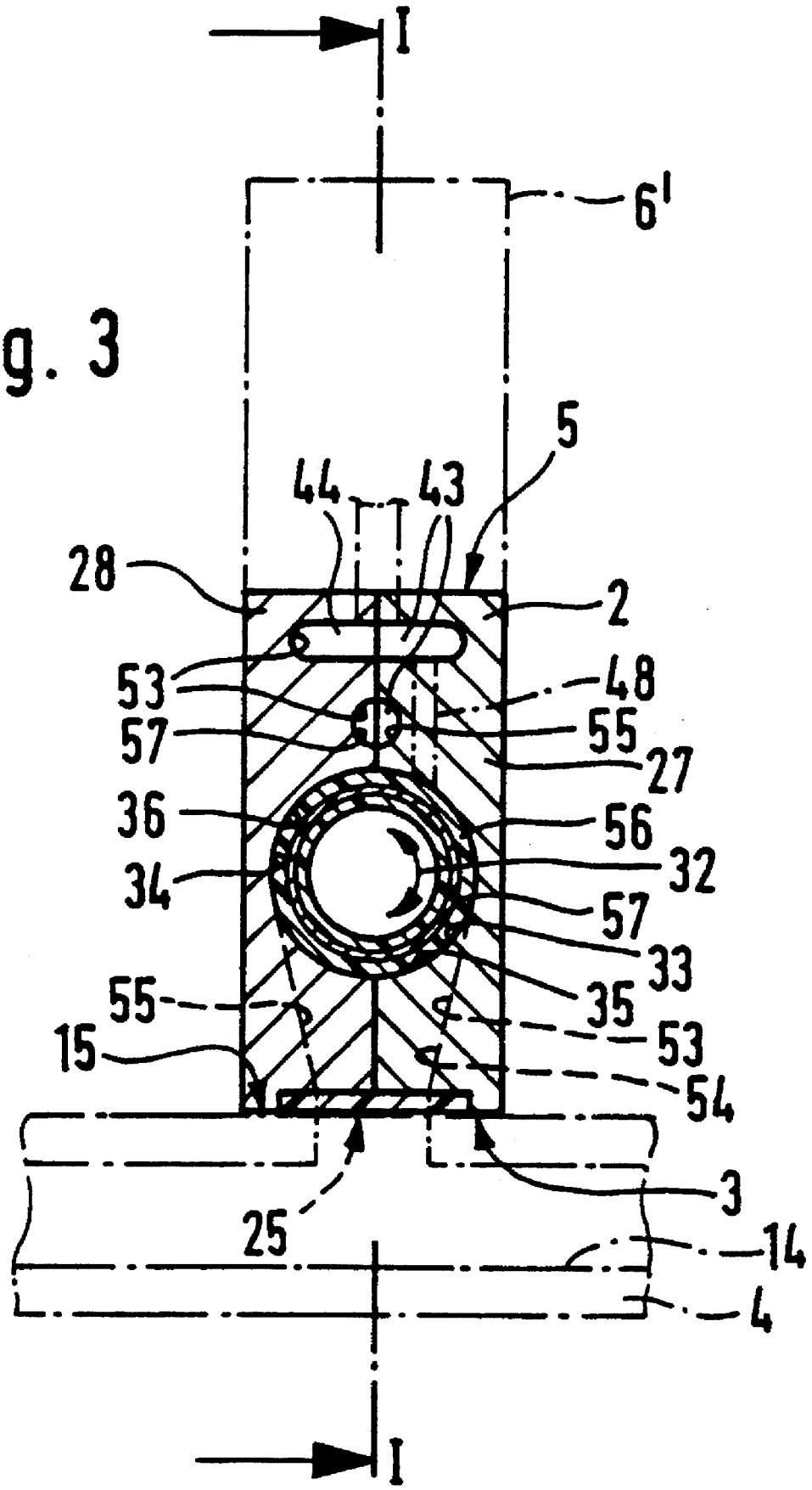
FIG. 3 is a cross section taken through the spool valve of figure taken on the section line III—III.

The spool valve 1 depicted by way of example comprises an elongated valve housing 2 with an external configuration corresponding to a rectangular block. As considered in the cross section in accordance with FIG. 3 it will be seen to possess a rectangular outline and the height of the housing is larger than the width thereof. One of the two narrow external surfaces of the valve housing 2 serves in the present case as a mounting surface 3, with which the spool valve 1 may be mounted on a fluid distributing or manifold device 4 of the type indicated in chained lines. The external surface, which is opposite to the mounting surface 3, and which in FIGS. 1 and 3 is upwardly directed, of the valve housing 2, may be conveniently utilized as a fitting surface 5 for the fitting of at least one and preferably—as indicated in chained lines in the drawing—two control valves 6 and 6'.

The spool valve 1 is suitable for being arranged in groups on a fluid distributing device 4. In this case it is convenient to employ a block- or plate-like fluid distributing device 4, which is integral or modular and which has several distribution ducts 14 extending through it which open via branch ducts in a certain arrangement pattern at separate mounting sites 15 on the fluid distributing device, at which a respective spool valve 1 may be mounted on its mounting surface 3. The spool valves 1 are in this respect preferably set in rows in sequence, the row direction coinciding with the width direction of the valve housing 2 so that a compact grouping of the valves is possible.

In the interior of the valve housing 2 a spool receiving space 12 is formed, which extends in the longitudinal direction 7 of the housing. In it a valve spool 13 as shown in chained lines diagrammatically is arranged, which has a more particularly circular cross section. At both axial end parts of the spool receiving space 12 there is a respective drive space 16 and 16', which serves to accommodate an actuating member 17 and 17' which is drivingly connected with the valve spool 13 or is at least able to be shifted also shown in chained lines and which is able to be axially shifted in the respective drive space 16 and 16'. For instance both actuating members 17 and 17α could be constituted by fluid operated actuating pistons, which would run axially in the associated control space 16 and 16'. Furthermore it would be feasible to employ drive diaphragms as well and as an additional feature at least one actuating member could be constituted by a return spring arrangement, which would hold the valve spool 13 in an initial setting.

The drive of the two actuating members 17 and 17' given in the example is by a fluid, that is to say using a control medium under pressure, which is supplied to the respective drive space 16 and 16' via a control valve duct 18 and 18', which opens into the respective drive space 16 and 16'.

In a fashion dependent of the selective pressure actuation of the one or the other actuating member 17 and 17' the valve spool 13 will assume different axial positions, referred to in this case as switching settings. In accordance with the respective switching position the valve spool 13 will set different flow paths in the valve housing 2 in cooperation with a sealing arrangement consisting of a plurality of separate sealing rings 22. In order to render this possible the valve spool 13, which in the working embodiment is circularly cylindrical, is provided at axial distances apart with circumferentially extending control grooves 23, and sealing rings 22 are so set in the spool receiving space 12 in axial succession in a coaxial array that they encircle the valve spool 13. Dependent on the switching position some of the sealing rings 2 will assume a position adjacent to a control groove 23, whereas simultaneously one or more other sealing rings 22 will be in sealing engagement with the portions of the valve spool which axially are adjacent to control grooves. It is in this manner that the fluid connection between the valve operating ducts 24 is controlled, of which in the working embodiment there are more than one in the valve housing 2 and with an axial spacing between two respectively adjacent sealing rings 22 open laterally in the peripheral part into the valve spool receiving space 12. The said valve operating ducts 24 open in the working embodiment at the other end thereof at the above mentioned mounting surface 3 in such a configuration that their associated openings 25 are in alignment with openings provided at the associated mounting site 15, of the distributing ducts 14.

The spool valve of the present example is designed in the form of a five way valve so that there is an advantage if in all six sealing rings 22 are present. Each of these sealing rings 22 is set in an annular holding recess 26, which is a direct component of the valve housing 2 and is molded in the valve housing 2, more especially directly. It is in this manner that the sealing rings 23 each have a dual function, since on the one hand they are responsible for a static sealing function with respect to the valve housing 2 and on the other hand exert a dynamic sealing function with respect to valve spool 13. An additional sleeve arrangement arranged between the valve housing 2 and the valve spool 13 and as described for instance in the said European patent publication 0 122 247 B1, is consequently unnecessary and the structure and assembly are accordingly substantially simplified.

The assembly of the sealing rings 22, which are preferably manufactured without connections between them, like those of the valve spool 13 and of any actuating members 17 and 17' present, is particularly simple in the case of the present spool valve 1, since the valve housing 2 is longitudinally divided. It is composed of a plurality of housing parts 27 and 28, which each constitute a portion 33 and 34 of the wall (extending some distance in the peripheral direction—as indicated by the double arrow 32—of the spool receiving space 22) including the associated peripheral portions 35 and 36 of the holding recesses 26 and otherwise extend without any transverse division at least along the length of the valve spool receiving space 12 and preferably along the entire length of the valve housing.

The illustrated arrangement is advantageous if the valve housing 2 is made up of two, and no more, housing parts 27 and 28 so that the wall portions 33 and 34, constituted by the same, of the spool receiving space 12 extend respectively for half of the periphery of the spool receiving space 12. The same will then apply for the peripheral portions 35 and 36 of the holding recesses 26 so that it is possible to speak of a semi-shell manner of design.

Each housing part 27 and 28 consequently defines a part of the spool receiving space 12, the parts fitting together in the assembled state of the housing parts 27 and 28 serving to define the complete spool receiving space 12. The arcuate length of the wall portions 33 and 34 just like that of the peripheral portions 35 and 36 is in the working embodiment equal to an angle of respectively 180°. The parting interface 37 present between the housing parts 27 and 28 is preferably in a plane extending both in the direction of the longitudinal axis 7 and also radially in relation to it. In the parting interface 37 the housing parts 27 and 28 with the joint surfaces 38 and 38' adapted to each other are placed on each other.

During the assembly of the spool valve 1 initially the two housing parts 27 and 28 are present in a separate state. Accordingly the spool receiving space 12 including the drive spaces 16 and 16' is peripherally open so that the sealing rings 22, the valve spool 13 and the actuating members 17 and 17' may be mounted in the one or the other housing part 27 and 28 without any problems. The direction of insertion extends in this case transversely and more particularly at a right angle to the longitudinal axis. Following this it is merely necessary to place the other housing part thereon and to join the two housing parts 27 and 28 permanently.

In the working embodiment the two housing parts 27 and 28 are screwed together, the assembly screws being indicated at 42. Other ways of connecting the parts together would be possible, as for instance by bonding and welding etc. The housing parts may be manufactured of plastic or metal.

In order to produce a seal at the parting interface 37, it is possible to insert a seal (not illustrated) in between. In the case of joint surfaces 38 and 38' as for example lapped ones, it is also possible however to produce a fluid-tight connection even without sealant. In order to improve the sealing action it is however to be recommended to coat at least one of the joint surfaces 38 and 38' with an elastomeric material prior to assembly thereof.

The spool valve 1 in accordance with the invention has, dependent on the particular design, a more or less large number of valve ducts 43, which extend outside the spool receiving space 12 in the wall of the valve housing 2. In the embodiment of the invention considered it is a question of the above mentioned valve working ducts 24, the control valve ducts 18 and 18' and a control fluid supply duct 44. The control valve ducts 18 and 18' have their respective end (opening 45), which is remote from the drive space 16 and 16', opening toward the mounting surface 5. Here they communicate with the already mentioned control valves 6 and 6' which furthermore communicate via openings 64 also provided at the mounting surface 5 with the control fluid supply duct 44. This duct is connected in the interior of the housing, with the supply duct 47 for the valve working ducts 24, that is to say inter alia via a transverse duct 48 as shown in chained lines. It is in this manner that a control pressure medium will always be present at the control valves 6 and 6' via the control fluid supply duct 44, such control medium being held back, in accordance with the state of operation of the respective control valve 6 and 6' or being passed to the associated control valve duct 18 and 18' for the switching over of the valve spool 18 into the respective control space 16 and 16'. In the case of the control valves 6 and 6' it is preferably a question of solenoid valves, which comprise a moving valve member controlling the passage of fluid between the control fluid supply duct 44 and the respective control valve duct 18 and 18'.

Since in the case of the spool valve in the present example it is a question of a five way valve, besides the supply duct 47 more particularly four further working valve ducts 24 are present, of which respectively two have the function of load ducts and relief or, respectively, venting ducts.

As a further valve duct 43 there is a compensating duct 49, which connects together the mutually adjacent portions of the drive spaces 16 and 16' subdivided by the respective actuating member 17 and 17'.

The number and the particular course of the valve ducts 43 inside the valve housing 2 is not necessarily limited to the working embodiment illustrated herein. Departures therefrom may be more especially dependent on the respective application and the surroundings of the valve in question. Since there is a tendency to make the valve as compact as possible, the designer will in certain cases wish to adopt forms of the ducts in the wall of the valve housing 2, which are difficult to produce using normal manufacturing technology. In the case of the spool valve 1 in accordance with the invention this problem is however solved, since a large proportion of the valve ducts 43 is so arranged that the same extend in the parting interface 37 between the two housing parts 27 and 28. The number of the respectively arranged valve ducts 43 may vary from one valve to another; furthermore it is possible to place merely one portion of the overall length, which is limited, of a single valve duct 43 in the parting interface 37. In any case the fact that at least one portion of the length of a valve duct 43 extends in the parting interface 37 of the valve housing 2 offers the advantage that the manufacture of the respective length portion may take place starting at one of the joint surfaces 38 and 38', which are accessible in an optimum fashion prior to fitting the same together. More particularly it is to be readily seen from FIGS. 2 and 3 that the wall 53 of such a respective duct 43 is composed of peripheral wall portions 54 and 55 along the longitudinal portion extending in the parting interface 37, which portions 54 and 55 are formed adjacent to the joint surfaces 38 and 38' at the housing parts 27 and 28, which meet in the parting interface 37. The peripheral wall portions 54 and 55 extend respectively along part of the overall periphery of the respective valve duct 43 are together in the fitted together condition of the housing parts 27 and 28 and build up a duct wall 53 which is peripherally complete and unbroken.

In the case of the spool valve 1 as illustrated both the control valve ducts 18 and 18' and furthermore the compensating duct 49 together with the working valve ducts 24 have their entire length inside the valve housing in the parting interface 37, which is preferably comprised in a single plane. The respective length portion extends in the present case at least substantially parallel to the parting interface 37. It is solely the control fluid supply duct 44 which extends only in part in the parting plane between the two housing parts 27 and 28. The portion of its length constituted by the transverse duct 48 is located outside the parting interface 37 in one (27) of the housing parts so that its duct wall is exclusively constituted by this one housing part 27. The transverse duct 48 is for example produced by drilling. Inclusion in the parting interface 37 is not possible in this case, since it would otherwise intersect with the compensating duct 49, the same extending in the part of the valve housing 2 above the spool receiving space 12.

In the working embodiment the length portions extending in the parting interface 37 of the valve ducts 43 are produced by fashioning recesses in the form of longitudinal grooves in both joint surfaces 38 and 38', which in the fitted together state of the housing parts 27 and 28 have their openings on the longitudinal side in overlapping relationship. Because of this each housing part 27 and 28 has part of the overall cross section of the respective duct length portion. Preferably in the case of there being two housing parts 27 and 28 each part of the cross section will have one respective half of the overall duct cross section, something which is readily to be seen in FIGS. 2 and 3. However it would certainly be possible to place the entire duct cross section in a single part of the housing and merely to cover over the open longitudinal side of the duct by means of the other housing part without providing a longitudinal recess there as well with an alignment in the longitudinal direction.

The spool valve 1 presented by way of example herein is indirectly pneumatically controlled with the aid of the electrically operated control valves 6 and 6', which set the supply of control fluid under pressure. However it would naturally be feasible to provide for a direct pneumatic control, in which case the control valves 6 and 6' could be dispensed with and the control valve ducts 18 and 18' present would open at the mounting surface 3 as shown in chained lines at 52, where they would then communicate with the distribution control duct extending in the fluid distributing or manifold device 4. The control valve ducts 18 and 18' described supra and also the control fluid supply duct 44 would not be necessary in this case.

If a portion of the length of a valve duct 43 extending in the parting interface 37 along the same should open at an external surface of the valve housing 2, the edge of the opening will preferably also be constituted by complementary portions of the opening's edge, which are provided on the mutually adjacent housing parts 27 and 28. A corresponding design is disclosed in figure 2.

As already mentioned, the parting interface 37 is preferably in the form of a plane of division. The same will preferably extend in the case of the valve housing 2 of the example, which is relatively narrow, in the longitudinal and vertical directions and is hence preferably at a right angle to the plane of the associated mounting site 15.

Finally some additional description is to be provided as regards the sealing rings 22. These rings are, as appears from FIG. 1, respectively exclusively produced from elastomeric material. It is however convenient to adopt the modified design depicted in FIG. 3, in accordance with which a respective sealing ring 22 comprises a sealing body 56 of elastic material and a support ring 57 partly embedded in the sealing body 56. The support ring 57 will then more particularly assume a position adjacent to the annular sealing body 56, which in the assembled state is essentially radially within the associated holding recess 26. The support ring 57, which is for example a metallic ring or a ring of hard synthetic resin, endows the sealing ring 22 generally with an improved strength. It is furthermore an advantage if the sealing rings 22 have such a cross sectional configuration that their sealing part, which is directed radially outwards and is provided for making sealing contact with the valve spool 13, is able to move axially to a limited extent. Accordingly damage to the sealing parts will be prevented when the same are put into use after a long period of non-use, since the sealing part is able practically to roll along the external surface of the valve spool.

It is an advantage if the valve housing 2 is exclusively composed of housing parts 27 and 28 assembled together at their longitudinal sides, which as in the present working embodiment also constitute the end housing walls so that separate housing covers are unnecessary.

We claim:

1. A spool valve comprising a valve housing in whose interior an axially extending spool receiving means is provided, in which a spool is located, the valve housing being longitudinally divided adjacent to the spool receiving means and having a plurality of housing parts fitted together along longitudinal sides thereof, a sealing arrangement adapted to function to define flow paths in the valve between the spool and a wall integral with the housing, and valve ducts serving to direct a working fluid, said ducts extending in the wall of the valve housing, wherein at least one length portion of each valve duct extends in a parting interface of the valve housing, the parting interface comprising a parting plane in which at least two parts of the valve housing are adjacent to one another, the length portion of the valve duct being composed of complementary wall peripheral sections, which are provided in the parting interface on the housing parts adjoining each other on longitudinal sides thereof, wherein at one axial end part at least of the spool receiving space a drive space is provided arranged in the interior of the longitudinally divided valve housing, the drive space serves to receive an actuating member adapted to be fluid driven by means of a control pressure medium, said actuating member serving for operation of the valve spool, and opens into a drive valve duct serving for the supply of the control pressure medium, said drive valve duct having its entire length extending in the parting interface and opens at an end opposite to the associated drive space at an external surface of the valve housing.

2. The spool valve as defined in claim 1, wherein the external surface, which contains the opening of the drive valve duct, comprises a mounting site for a fluid control means.

3. The spool valve as defined in claim 1, wherein the external surface, which contains the opening of the drive valve duct includes mounted thereon a fluid distributing device.

4. The spool valve as defined in claim 1, wherein the plurality of axially spaced out working valve ducts open laterally into the spool receiving space, the working valve ducts including a supply duct, a load duct and at least one relief duct, the working valve ducts including an opening in an external surface of the housing and having the entire length thereof extending in the parting interface.

5. The spool valve as defined in claim 1, wherein externally the valve housing possesses a configuration with a substantially rectangular cross section, such that a vertical dimension is greater than a width dimension.

6. The spool valve as defined in claim 1, wherein the sealing arrangement comprises a plurality of sealing rings, which are provided for producing a direct sealing contact with the valve spool and arranged coaxially with respect to the valve spool while being arranged axially in sequence with a spacing between them, such sealing rings being held in fixed relationship with respect to the housing in annular holding recesses formed in the longitudinally divided valve housing, such recesses being constituted by Wall portions of peripheral portions of the recesses formed by the individual housing parts.

7. The spool valve as defined in claim 6, wherein the sealing rings are separate rings formed individually.

8. The spool valve as defined in claim 6, wherein each respective sealing ring comprises an annular sealing body of elastic material, which is connected with a coaxially arranged support ring.

9. A spool valve comprising:

a valve housing, the valve housing having provided in an interior space thereof, an axially extending spool receiving space, the valve housing being longitudinally divided along the spool receiving space into at least two parts such that the internal space of the housing parts define a portion of a wall of the spool receiving space, the spool receiving space having at least one drive space provided at an axial end thereof;

a spool positioned within the spool receiving space for reciprocative movement therein; the spool being operatively coupled to at least one actuating member at an axial end thereof; the actuating member being positioned within the drive space and adapted to be fluid driven by means of a control pressure medium;

a sealing arrangement to define flow paths in the valve receiving space between the spool and a wall integral with the housing, the valve spool being coaxially encircled by the sealing arrangement;

valve ducts to direct a working fluid, the ducts extending in the wall of the housing such that at least a portion of the duct is formed in an interface of the valve housing parts such that the portions of the duct are formed in complementary walls of adjoining housing parts; and a control valve duct having its entire length formed in complementary walls of adjoining housing parts and having at least a part of its length adjacent to the drive space, the control valve duct providing a passageway for the working fluid to drive the actuating member, the control valve duct having an open end provided on an external surface of the valve housing, the external surface of the housing forming a mounting site for a fluid control means which controls the supply of working fluid to the control valve duct.

10. A spool valve as defined in claim 9, wherein the fluid control means is a solenoid valve mounted to the external surface of the housing to cooperate with the control valve duct opening.

11. A spool valve as defined in claim 9, wherein the fluid control means is a fluid distributing device mounted to the external surface of the housing to cooperate with valve ducts thereon.

12. A spool valve as defined in claim 9, further comprising a plurality of axially spaced working valve ducts having a first end with openings cooperating with the spool receiving space, each working valve duct having a second end which opens to an external surface of the valve housing, the working ducts having at least a portion of the duct being formed in an internal portion of complementary housing parts.

13. A spool valve as defined in claim 12, wherein the working valve ducts include a supply duct, a load duct and at least one relief duct.

14. A spool valve as defined in claim 9, further comprising a control fluid supply duct for cooperation with the fluid control means, the control fluid supply duct having at least a portion of the duct formed in an internal portion of complementary housing parts and having openings provided on an external surface of the value housing for cooperation with the fluid control means.

15. A spool valve as defined in claim 9, wherein the sealing arrangement comprises a plurality of sealing rings in direct sealing contact with the valve spool, the sealing rings being axially spaced apart and housed in annular holding recesses formed in the spool receiving space, the seal holding recesses being defined by wall portions of complementary housing parts.

16. A spool valve as defined in claim 15, wherein the sealing rings are individually formed.

17. A spool valve as defined in claim 15, wherein the sealing rings comprise an annular sealing body connected by a coaxially arranged support ring.

18. A spool valve as defined in claim 9, wherein both axial ends of the spool receiving space are provided with a drive space, each drive space communicating with a control valve duct, the control valve ducts having respective openings to an external surface of the valve housing.

* * * * *